United States Patent [19]

Baxter, II

[11] Patent Number: 4,766,737

[45] Date of Patent: Aug. 30, 1988

[54] REFRIGERATED STORAGE AND DISPLAY DEVICE WITH MULTIPLE PAN DISSIPATOR ARRAY

[75] Inventor: Franklin Baxter, II, Huntington Beach, Calif.

[73] Assignee: Displaymor Manufacturing Company, Los Angeles, Calif.

[21] Appl. No.: 492,939

[22] Filed: May 9, 1983

[51] Int. Cl.[4] ..... F25B 47/00

[52] U.S. Cl. ..... 62/279; 62/291; 141/286; 261/114.1

[58] Field of Search ..... 62/277, 279, 280, 285, 62/291; 261/114 R, 118 R, 125; 141/286

[56] References Cited

U.S. PATENT DOCUMENTS

| | | | |
|---|---|---|---|
| 687,278 | 12/1901 | Cookson | 261/114 R X |
| 1,991,702 | 2/1935 | Safford | 62/279 |
| 2,112,771 | 3/1938 | Goulooze | 62/277 X |
| 2,187,397 | 1/1940 | Goggins | 62/280 X |
| 2,296,997 | 9/1942 | Knox | 62/279 |
| 2,671,320 | 3/1954 | Patterson, Jr. | 62/279 |
| 2,721,451 | 10/1955 | Schumacher | 62/279 |
| 3,225,563 | 12/1965 | Braun | 62/280 X |
| 4,280,334 | 7/1987 | L'Akpawala | 62/277 |

*Primary Examiner*—William E. Tapolcai
*Attorney, Agent, or Firm*—Thomas P. Mahoney

[57] ABSTRACT

The device may be of the type having a horizontally open display section along the major portion of at least one side thereof which is maintained cool by a cool air flow stream passing downwardly through the display section, rearwardly of the section, and then upwardly and forwardly back to its point of origination to begin another cooling cycle. The air flow stream is maintained cool by a refrigeration system preferably having an upper condenser assembly and a lower evaporator assembly with an improved condensate dissipator assembly just beneath and in flow communication with the condenser assembly. This dissipator assembly may include a multiplicity of pans mounted spaced apart one beneath the other arranged for the condenser assembly warm air to pass therethrough above and beneath the pans with condensate from the evaporator assembly coil being directed into at least the uppermost of the pans. The majority of pan edges in the general direction of air flow are angled from vertical and preferably include weep holes therein with condensate flow from the upper to the lower thereof flowing over and through the edge weep holes and along undersurfaces thereof, at least the lower pans increasing progressively in horizontal dimensions. A portion of the condenser assembly high temperature coil may be associated with the lowermost pan for transferring heat to the lowermost pan.

7 Claims, 2 Drawing Sheets

REFRIGERATED STORAGE AND DISPLAY DEVICE WITH MULTIPLE PAN DISSIPATOR ARRAY

BACKGROUND OF THE INVENTION

This invention relates to a refrigerated storage and display device of the general type having a horizontally open display section along the major portion of at least one side thereof which is maintained cool by a refrigerated, air flow stream passing downwardly through the display section. Devices of this type are disclosed in U.S. Pat. No. 2,905,335, issued Sept. 22, 1959 for Storage and Display Device, and U.S. Pat. No. 4,373,355, issued Feb. 15, 1983 for Dual Refrigerated Display Cabinet. More particularly, this invention relates to an improved multiple pan, dissipator array in the refrigeration system warm air environment which may be formed of a multiplicity of unique, vertically stacked and spaced pans, one beneath the other, and which receives condensate from the refrigeration system for evaporating the same by the flow of warm refrigeration system generated air therethrough and with or without the use of additional heat assistance dependent on the particular system involved. The basic purposes of the improvements of the present invention is the efficient operation of the refrigerated storage and display device while making use of a minimum of valuable energy.

Various forms of refrigerated storage and display devices are commonly used in food supermarkets, the smaller grocery stores and the like. Probably the major purpose thereof is for the display and sale of comestibles such as eggs, spiritous beverages and preserved meats. Furthermore, the most common general form of storage and display device is that having at least one horizontally open display section along the major portion of at least one side thereof, although many will now have opposite side open display sections.

The important point is that this horizontally open display section requires refrigeration by some form of refrigeration unit in order to retain the comestibles displayed therein at the desired temperature. For instance, the refrigeration unit cools a stream of air which is forced downwardly through the horizontally open display section in an air flow path to cool the comestibles therein, the air flow path continuing rearwardly at the display section and finally forwardly ultimately back to its point of origination to begin another cycle downwardly through and cooling the display section. At the same time, the condensate derived from the refrigeration unit must be evaporated and this is done by directing the condensate into some form of dissipator having warm air flowing thereover as generated by the refrigeration unit.

Now it is well known in today's economy that the conservation of energy is an important factor and this is particularly true in refrigerated storage and display devices of the type presently involved. Progressively more efficient refrigeration units are being designed, but an important factor which has not been considered is the dissipator therefor for evaporating the constantly supplied condensate. These prior dissipators according to modern day design have been constructed for making use of a relatively large amount of electricity for heating the same in order to, in turn, heat the constantly supplied condensate for the evaporation of the same. If these dissipators can be re-designed to make use of far less energy and in many cases, no additional energy for the performance of their important function, improvement in the overall design may be accomplished.

OBJECTS AND SUMMARY OF THE INVENTION

It is, therefore, an object of this invention to provide a refrigerated storage and display device with multiple pan dissipator array wherein the novel multiple pan dissipator array adapts most prior refrigerated storage and display devices to no longer require outside energy for evaporating the refrigeration unit condensate and when such outside energy is required, it is of far less quantity, thereby creating an energy saving overall device. The improved dissipator in the overall storage and display device has far greater condensate evaporator capacity than the prior dissipator devices while operating in a highly efficient manner. Thus, the need for energy assistance can be virtually eliminated while still producing maximum performance.

It is a further object of this invention to provide a refrigerated storage and display device with the multiple pan dissipator array as hereinbefore indicated and supplying the above advantages, yet the improved dissipator is relatively simple in construction and may be mounted in virtually the same location as prior dissipator assemblies. In a preferred form, the dissipator includes a multiplicity of pans mounted spaced apart, one beneath the other and aligned for condensate to flow from an upper pan downwardly to a lower pan, the pans being positioned in the refrigeration unit warm air environment for the warm air to flow over and beneath the pans and the condensate supply being directed into the uppermost of said pans. Starting with this basic structure, various other dissipator improvements may be provided incorporated therein and dependent on the degree of evaporator efficiency desired and all of which will be hereinafter discussed in detail.

Other objects and advantages of the invention will be apparent from the following specification and the accompanying drawings which are for the purpose of illustration only.

DESCRIPTION OF THE BEST EMBODIMENTS CONTEMPLATED

Figure 1:
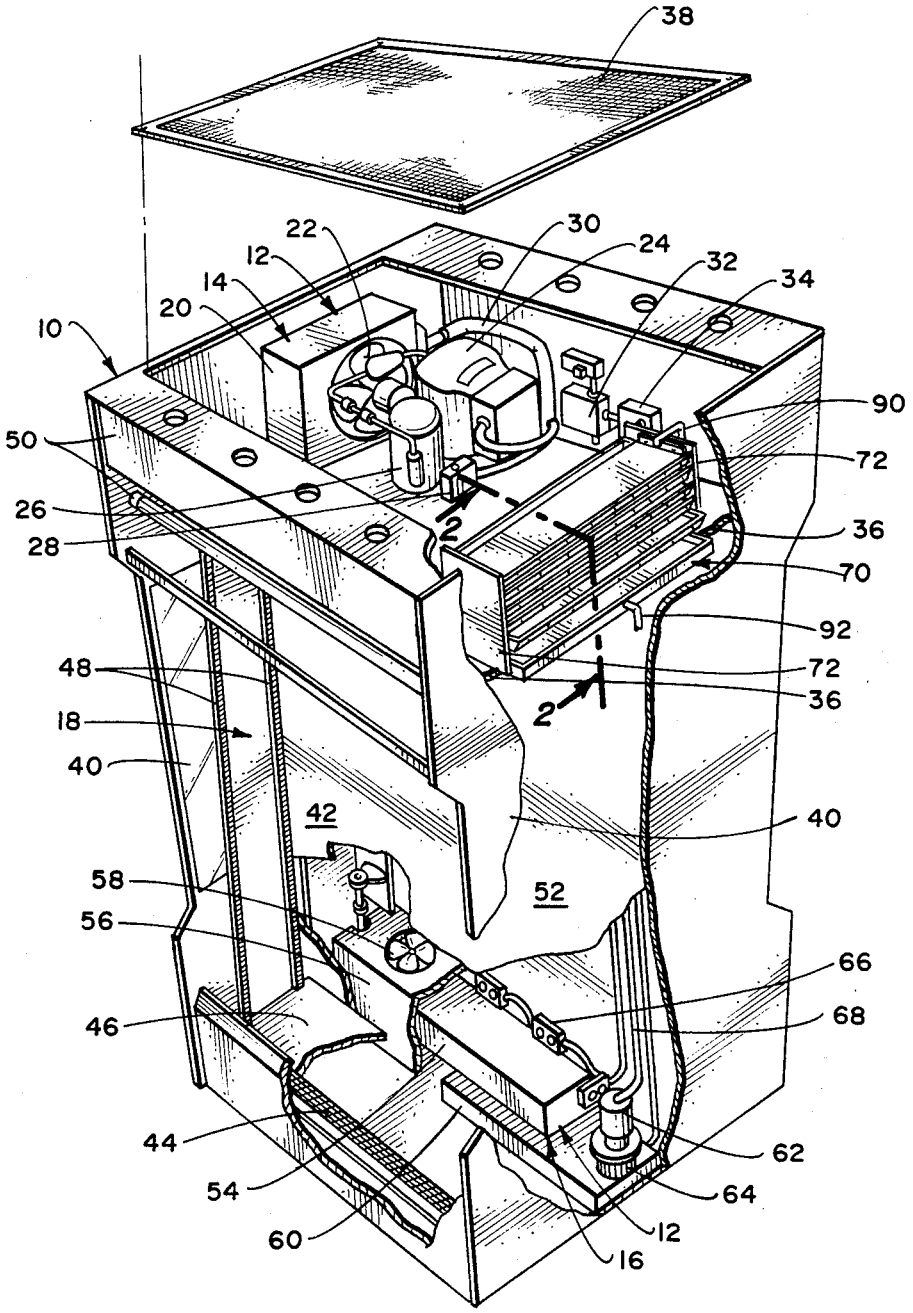
FIG. 1 is a perspective view of a preferred embodiment of the refrigerated storage and display device with multiple pan dissipator array of the present invention looking at the horizontally open display section thereof with parts broken away to show the details thereof.

Referring to FIG. 1 of the drawings, a preferred embodiment of a refrigerated storage and display device is generally shown at 10 and includes a refrigeration unit generally indicated at 12 made up of a condenser assembly generally indicated at 14 and an evaporator assembly generally indicated at 16. Spaced vertically between the condenser and evaporator assemblies 14 and 16 of the refrigeration unit 12 are horizontally open display sections generally indicated at 18, one opening generally forwardly and the other opening generally rearwardly as viewed in FIG. 1. In view of the fact that both the display sections 18 are virtually identical, only one will be described in detail since a description of one would suffice for the other. Furthermore, the overall refrigerated storage and display device 10, except as noted otherwise, may be formed of usual materials and according to standard manufacturing processes.

The condenser assembly 14 of the refrigeration unit 12 is located at the top portion of the device 10 and is generally of standard construction including a condenser 20, a condenser fan 22, a compressor 24, a receiver 26 and various controls 28 and liquid flow lines 30. The condenser assembly 14 is electrically powered and connected through an electrical junction box 32 and an electrical switch 34. Furthermore, the condenser assembly 14 is shielded from the remainder of the device 10 by a partition 36 and is provided with a wire guard cover 38.

One of the display sections 18 is shown in detail in FIG. 1 and is formed by side panels 40 of the device 10 closed at the rear by a back panel 42 and extends as a horizontally open display section along the major portion of this front side of the device 10. This display section 18 opens upwardly and rearwardly beneath the partition 36 of the refrigeration unit condenser assembly 14 and downwardly at its lower end through a return air grill 44 and rearwardly beneath a display section bottom deck 46. Thus comestibles (not shown) of various types may be supported in the display section 18 on shelves supported by shelf standards 48 and possibly in wire baskets, the same being lighted by usual upper fluorescent lights 50 for viewing and removal by customers from the horizontally open display section 18. As hereinbefore pointed out, this particular device 10 has oppositely opening display sections 18 and the one just described is at the device forward section as shown in FIG. 1 while the other is substantially identical and opens rearwardly of the device.

The evaporator assembly 16 forming the other portion of the refrigeration unit 12 is located to the rear of the display section back panel 42 generally centrally of the device 10 and at a lower portion of a vertically extending return air duct 52. The return air duct 52 forms the central portion of the device 10 so that the one display section 18 is forwardly thereof and the other display section 18 is rearwardly thereof, both identically feeding the flow of cool air in identical fashion to the upper portion of the device ready to start the next loop of circulating cool air. Furthermore, just as the condenser assembly 14, the evaporator assembly 16 is generally of usual form including an evaporator coil 54 covered by an evaporator coil housing 56, an evaporator coil fan 58, a drip pan 60 for collecting condensate from the evaporator coil and a water pump 62 connected to the drip pan by a strainer basket 64. The evaporator assembly 16 is electrically connected to the overall system by usual electrical junction boxes 66 and the water pump 62 is connected through a water pump line 68 upwardly through the return air duct 52 and through the condenser assembly partition 36 for a purpose to be hereinafter described in detail.

Figure 2:
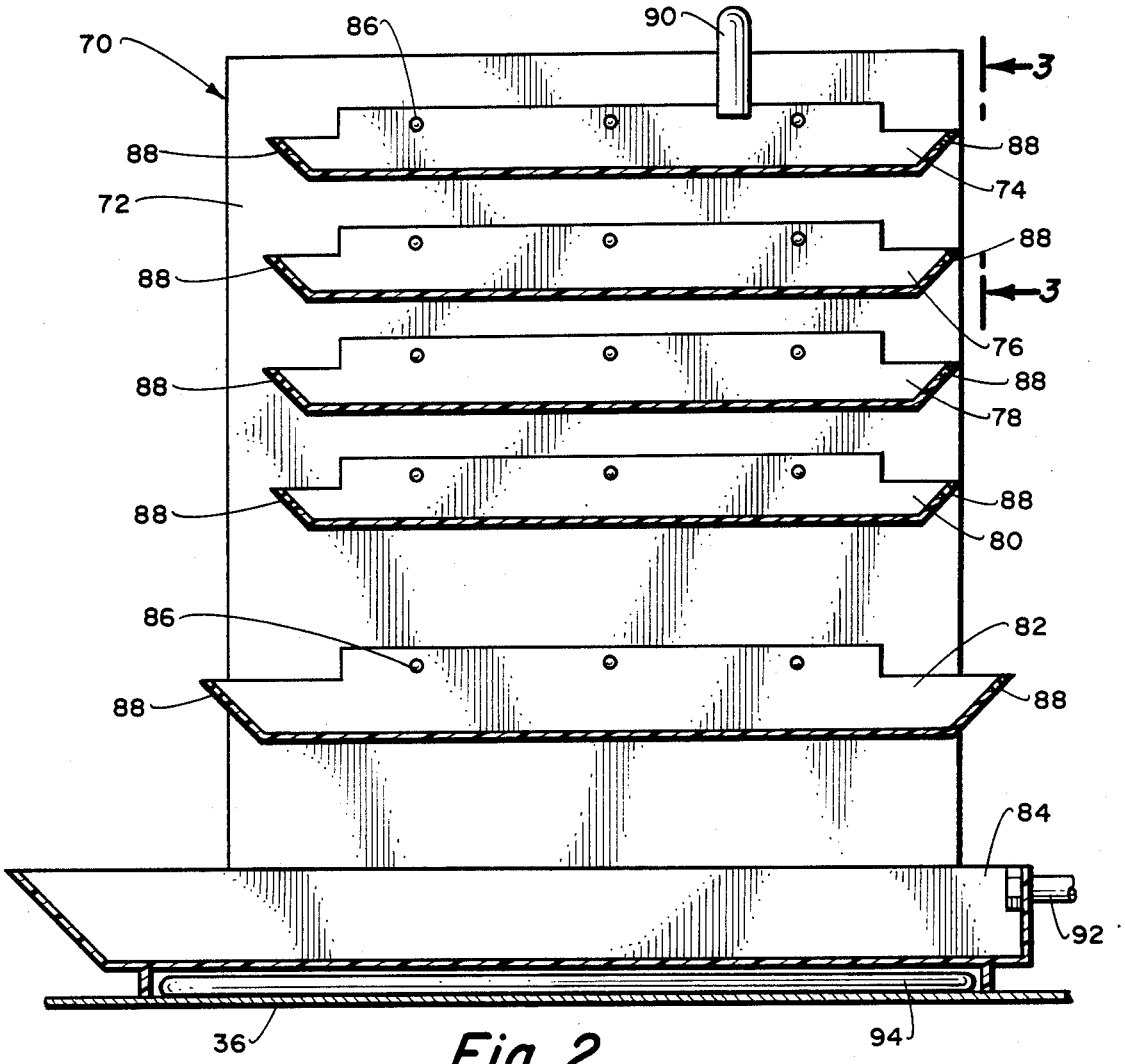
FIG. 2 is an enlarged fragmentary, vertical sectional view looking in the direction of the arrows 2—2 in FIG. 1 and showing the multiple pan dissipator array.
Figure 3:
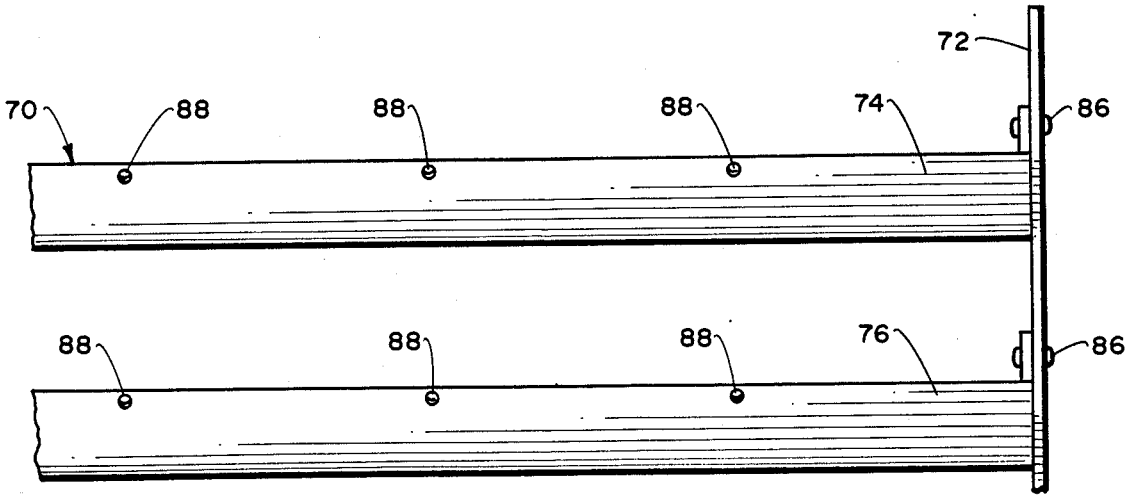
FIG. 3 is a vertical section view looking in the direction of the arrows 3—3 in FIG. 2 and showing more details of the pans.

More particularly to the improvements of the present invention, just above the partition 36 shielded from the lower remainder of the device 10 and in warm air communication with the condenser assembly 14 is mounted the multiple pan dissipator array generally indicated at 70, the first embodiment thereof being shown in FIGS. 1, 2 and 3. The multiple pan dissipator array 70 includes a pair of spaced and vertically extending sides 72 mounting a multiplicity of shallow pans, in this case six pans 74, 76, 78, 80, 82 and 84. The pans 74 through 84 are preferably riveted by the rivets 86 at the sides thereof to the sides 72 spaced apart, one beneath the other in vertical alignment. This provides open ends for the pans 74 through 84.

As best seen in FIG. 2, the uppermost pan 74 and the three pans 76, 78 and 80 therebeneath are all of approximately the same size with the next to lowermost pan 82 being slightly larger and the lowermost pan 84 still larger. The open ends of the pans 74 through 84, with the exception of one of the ends on the lowermost pan 84, are angled from vertical and the open ends of the five upper pans 74 through 82 are each formed with a multiplicity of weep holes 88 therethrough as shown in both FIGS. 2 and 3. The weep holes 88 are spaced slightly downwardly from the extreme edges of the particular pan open ends as shown.

A condensate outlet 90 is directed into the uppermost pan 74, this being the end of the water pump line 68 from the water pump 62 and upwardly through the partition 36 as previously described. An overflow line 92 is connected into and extends from the lowermost pan 84 downwardly through the return air duct 52 for disposal on an emergency basis. Finally, a high temperature coil 94 forming an integral part of the refrigeration unit condenser assembly 14 is positioned beneath the lowermost pan 84 above the partition 36 for the purpose of adding heat to this lowermost pan for heating the same to increase its evaporating quality and which ordinarily would merely be lost. Particularly, it should be noted that this multiple pan dissipator array 70 does not require the use of electrical power, thereby having distinct saving affect.

In general use, the refrigerated storage and display device 10 operates in normal fashion, the air stream being cooled by the refrigeration unit 12 and passing downwardly in an air stream path through the display sections 18, then through the return air grills 44 to the central return air duct 52, then upwardly and forwardly and rearwardly to its point of origination to begin another air flow cycle downwardly. At the same time, and according to the improvements of the present invention, cooling air results in condensate which is directed into the multiple dissipator array 70, passing above and between all of the pans 74 through 84 and so that condensate may be evaporated from the various pans. More particularly, condensate is emitted into the uppermost pan 74 and flows downwardly between the pans with part thereof ultimately arriving at the lowermost pan 84. Due to the particular formations of the initial five pans 74 through 82 with their angled pan edges and weep holes 88 therein, the condensate flows over and through the weep holes thereof and along undersurfaces thereof so as to gain increased contact between the condensate and the warm air flow to provide extremely efficient evaporation of the condensate, thereby eliminating the need for additional heating means as hereinbefore pointed out.

Figure 4:
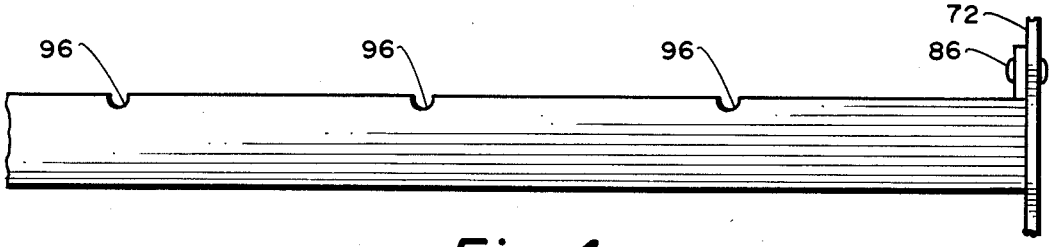
FIG. 4 is a view similar to FIG. 3, but showing a second embodiment of the pans.

The second embodiment of the present invention is illustrated in FIG. 4 and the refrigerated storage and display device 10 is identically the same as the first embodiment with only a slight change in the formation of the multiple pan dissipator array 70. As shown therein, there is illustrated any one of the pans 74 through 82 with weep holes 96 which are at the extreme edges of the pan open ends so as to also open upwardly. This form of weep holes 96 could be substituted for the weep holes 88 in the first embodiment and merely shows the possible variations thereof for accomplishing the intended function. These weep holes could be increased in size or could be increased in number and all of this is contemplated within the principles of the present invention.

Thus, a somewhat standard refrigerated storage and display device 10 is provided with an improved multiple pan dissipator array 70 which replaces the prior dissipators and eliminates, in most cases, the need for any energy to accomplish the condensate evaporation. The dissipator pans 74 through 84 are stacked in an efficient manner so that condensate passing thereover and between pans derives maximum exposure to the warm air flow therethrough. Furthermore, this same multiple pan dissipator array may be used with many other refrigerated storage and display devices of different form and shape while gaining the same advantages as have been illustrated herein, the complete elimination of energy for evaporating condensate or at least a large reduction thereof dependent on the particular device involved.

Although the principles of the present invention have been herein illustrated in a particular embodiment or embodiments of refrigerated storage and display devices, it is not intended to limit such principles to that particular device alone, since the same principles are readily applicable to various other forms of such devices. Thus, the principles of the present invention should be broadly construed and not limited beyond the specific limitations set forth in the appended claims including the patent equivalents thereof.

I claim:

1. In a refrigerated storage and display device of the general type having a horizontally open display section along the major portion of at least one side thereof, and air flow cooled by a refrigeration unit having an air flow path passing downwardly through the display section and then rearwardly and upwardly ultimately back to its point of origination to begin another cycle downwardly through the display section; an improved condensate dissipator assembly as part of the refrigeration unit including: a multiplicity of pans mounted spaced apart one beneath the other aligned for condensate to flow from an upper pan downwardly to a lower pan, said pans being positioned for evaporating air to flow over and beneath said pans, a condensate supply directed into said upper pan, certain edges of said pans being arranged for condensate flow on both upper and under surfaces of said pans.

2. In a refrigerated storage and display device as defined in claim 1 in which certain edges of said pans have a multiplicity of weep holes formed therethrough, at least a portion of condensate flowing through said weep holes flowing along an under surface of said pans.

3. In a refrigerated storage and display device as defined in claim 1 in which at least certain edges of said pans having a multiplicity of weep holes formed therethrough, said weep holes opening upwardly of said pan edges, condensate flowing through said weep holes having at least a portion thereof flowing along under surfaces of said pans.

4. In a refrigerated storage and display device as defined in claim 1 in which certain edges of said pans are angled from vertical, said angled pan edges being arranged for at least a portion of condensate flow both on upper surfaces of said pans and under surfaces thereof.

5. In a refrigerated storage and display device as defined in claim 1 in which certain of said pan edges are formed angled from vertical, said angled pan edges being formed with a multiplicity of weep holes therein, said condensate flowing in and through said angled pan edges and through said weep holes with at least a portion onto under surfaces thereof.

6. In a refrigerated storage and display device as defined in claim 1 in which certain of said pan edges are angled from vertical, said angled pan edges having a multiplicity of weep holes formed therein, the condensate flowing over said pans and through said weep holes of said pans with at least a portion thereof along pan under surfaces, said lower pan being larger horizontally than a remainder of said pans.

7. In a refrigerated storage and display device as defined in claim 1 in which certain of said pan edges are angled from vertical, said angled pan edges having a multiplicity of weep holes formed therein, the condensate flowing over said pans and through said weep holes of said pans with at least a portion thereof along pan under surfaces, said lower pan being larger horizontally than a remainder of said pans; and in which a portion of a high temperature coil of said refrigeration unit is positioned at and heating said lower pan.

* * * * *